US005611602A

United States Patent [19]

Brady

[11] Patent Number: 5,611,602

[45] Date of Patent: Mar. 18, 1997

[54] SEATS FOR SWINGS

[75] Inventor: David F. Brady, West Yorkshire, Great Britain

[73] Assignee: Sutcliffe Leisure Limited, West Yorkshire, United Kingdom

[21] Appl. No.: 335,882

[22] PCT Filed: May 21, 1993

[86] PCT No.: PCT/GB93/01049

§ 371 Date: Nov. 15, 1994

§ 102(e) Date: Nov. 15, 1994

[87] PCT Pub. No.: WO93/24195

PCT Pub. Date: Dec. 9, 1993

[30] Foreign Application Priority Data

May 29, 1992 [GB] United Kingdom ..... 9211377

[51] Int. Cl.[6] ..... A47C 7/02

[52] U.S. Cl. ..... 297/452.23; 297/DIG. 2

[58] Field of Search ..... 297/452.1, 452.21, 297/452.23, 452.24, 452.55, 452.57, DIG. 2; 472/118, 106

[56] References Cited

U.S. PATENT DOCUMENTS

| | | | |
|---|---|---|---|
| 1,964,903 | 7/1934 | Bronson | 297/452.24 X |
| 1,975,262 | 10/1934 | Evans et al. . | |
| 2,225,737 | 12/1940 | De Vaney . | |
| 3,758,159 | 9/1973 | Morris | 297/452.55 X |
| 3,897,056 | 7/1975 | Hock et al. . | |
| 3,905,643 | 9/1975 | Lamkemeyer | 297/DIG. 2 X |
| 4,066,258 | 1/1978 | Yates | 297/452.57 X |
| 4,524,966 | 6/1985 | Shannon et al. . | |
| 5,269,590 | 12/1993 | Carilli | 297/452.55 |

FOREIGN PATENT DOCUMENTS

| | | | |
|---|---|---|---|
| 1457271 | 12/1976 | United Kingdom . | |
| 1535728 | 12/1978 | United Kingdom . | |
| 2037595 | 7/1980 | United Kingdom . | |
| 2063082 | 6/1981 | United Kingdom | 472/118 |
| 2194739 | 3/1988 | United Kingdom | 472/118 |
| 2207344 | 2/1989 | United Kingdom . | |

*Primary Examiner*—Milton Nelson, Jr.

*Attorney, Agent, or Firm*—Burns, Doane, Swecker & Mathis LLP

[57] ABSTRACT

A seat for a child's swing is of the type having a plate-like substantially rigid member to bear the weight of a user sitting on the seat, and resilient polymeric material secured to the plate-like member. The resilient polymeric material extends beyond the outline of the plate-like member to form a border around the edges of the plate-like member, and forms a peripheral dependent skirt of substantial thickness. To achieve greater safety in use, the border includes a hinge-like portion of the resilient material, the plate-like member in the region of the hinge-like portion is configured to provide room for the dependent skirt to hinge beneath the plate-like member, and in an impact between the edge of the seat adjacent the hinge-like portion and an object, the skirt is progressively deformed and forced to hinge inwards against the resilience of the hinge-like portion.

28 Claims, 4 Drawing Sheets

SEATS FOR SWINGS

BACKGROUD OF THE INVENTION

1. Field of the Invention

This invention relates to seats for swings of the type used by children, in playgrounds, for example.

2. Discussion of Related Art

It has long been recognized that the seat of a swing can cause serious injury on impact, particularly if a child is struck on the head by such a seat.

One approach to improving the safety of such swings has been to make the seat extremely light, for example, by making the seat in the form of a flexible belt (see, for example, U.S. Pat. No. 3,897,056) or by making a rigid seat using only lightweight plastics material (see, for example, U.S. Pat. No. 2,225,737). Unfortunately, the flexible belt type swing seat is not very popular with users and is susceptible to vandalism, and an all-plastics rigid seat can cut and bruise because of its hardness and is again susceptible to vandalism.

Another approach to improving safety has been to provide a rigid reinforcing structure surrounded by a cushioning structure. That is, a cushioning structure is interposed between a rigid core member and an impacting object. Such structures conform more closely to the traditional wooden swing seat and are more popular with users and more resistant to vandalism than the belt type and lightweight plastics seats just mentioned. Early examples of such an approach are to be found in United U.S. Pat. No. 1,975,262 dated 2nd Oct., 1934 and U.S. Pat. No. 2,225,737 dated 24th Dec., 1940.

More recently, attempts have been made to make the cushioning structure still safer in impact, for example, as described in our British patent No. 1,535,728. Swing seats made in accordance with our British patent No. 1,535,728 have proved very successful in test and commercially.

Another example of the same approach is to be found in British patent No. 2,207,344.

Old car tries when used for swings have sometimes been provided with a rigid wooden center and so provide yet another example of a cushioning structure surrounding a rigid member.

Cushioning surrounding a rigid member is not, however, in itself sufficient to make a safe swing seat as the seat may well have too much mass to be safe in impact and/or take up energy too quickly. The mass may arise from the quantity of material required in the cushioning and/or the quantity of material required to impart sufficient strength to the rigid member. The old car tire provided with a wooden center is an example of such a seat that is too massive to be truly safe.

Thus, for more than fifty years attempts have been made to devise a form of cushioning that will render a swing seat safe in impact,it is an object of the invention to provide a swing seat of the traditional bench type that has greater safety than known types of seats of that type with safety cushioning.

SUMMARY

The present invention provides a seat for a child's swing, the seat comprising a plate-like substantially rigid member to bear the weight of a user sitting on the seat, and resilient polymeric material secured to the plate-like member, the resilient polymeric material extending beyond the outline of the plate-like member to form a border around the edges of the plate-like member, and forming a peripheral dependent skirt of substantial thickness, wherein the border includes a hinge-like portion of the resilient material, in that the plate-like member in the region of the hinge-like portion is configured to provide room for the dependent skirt to hinge beneath the plate-like member, and in that, in use, in an impact between the edge of the seat adjacent the hinge-like portion and an object, the skirt is progressively deformed and forced to hinge inwards against the resilience of the hinge-like portion.

Such a seat reacts in the impact by the skirt deforming progressively and being forced to hinge inwards against the resilience of the hinge-like portion rather than the skirt being compresssed between the impacting object and the plate-like member. We have discovered that in an impact this progressive deformation and hinge-like action gives a dramatic improvement in the results of safety tests, even over the results of tests on swing seats described in British specification 1,535,728. This progressive deformation and hinge-like action differs radically from the approach described above of using cushioning effects to absorb energy. In particular, the progressive deformation and hinge-like action enables a good result in the impact safety test of British Standard No. 5696 to be achieved using a relatively small amount of resilient material. The use of a relatively small amount of resilient material is important because the seat can then be kept light. A seat that relies on a large volume of resilient material to pass that particular test is very undesirable because it will still be unsafe in impact by virtue of its great mass.

Advantageously, the hinge-like portion is constituted by a web of the polymeric material and the resilience of the hinge-like portion is provided by the polymeric material. Such an arrangement provides a very simple means of achieving both a hinge and resilience.

Preferably, the hinge-like portion extends into the skirt. Because the skirt has substantial thickness, extending the hinge-like portion into the skirt ensures that a high degree of resilient stiffness is achieved.

Preferably, the dependent skirt has a thickness of ten or more millimeters, more preferably a thickness of fifteen or more millimeters, and yet more preferably a thickness of twenty or more millimeters. The greater thickness of the skirt makes it harder to deform and hinge inwards.

Advantageously, the dependent skirt is thicker at its base than at its distal end. By that means, a high degree of resilient stiffness can be imparted to the hinge-like portion.

The skirt, at least in part, may be of stepped cross-section comprising a first, thicker, base section and a second, thinner distal section.

Preferably, the seat is oblong and the skirt has the stepped cross-section along major sides of the oblong.

The skirt may be constituted by a solid wall of the polymeric material but preferably the skirt has a thickness of fifteen or more millimeters and includes a multiplicity of blind apertures extending into the skirt from its distal end. By that means, weight can be saved and the structure may contribute to the absorption of energy in the manner described in British patent specification 1,535,728.

When the skirt, at least in part, is of stepped cross-section and comprises a first, thicker, base section and a second, thinner distal section, a multiplicity of blind apertures may extend into the base section from its distal end.

Preferably, the thickness of the skirt at its base is twenty-five or more millimeters.

Preferably, the thickness of the skirt at its base is substantially equal to the width of the border. By that means, a high degree of resilient stiffness can be given to the hinge-like member.

Preferably, the overall depth of the skirt is 25 or more millimeters and more preferably the overall depth of the skirt is 35 or more millimeters.

Preferably, the depth of the dependent skirt is five or more times the depth of the plate-like member at its periphery, more preferably eight or more times the depth of the plate-like member at its periphery, and yet more preferably, ten or more times the depth of the plate-like member at its periphery. With such dimensions, a good balance can be achieved between strength, weight and safety and use.

Preferably, the plate-like member has a lip at its periphery. By that means, any tendency of the plate-like member to act as a cutting member is reduced.

In a preferred arrangement, the seat is oblong, the plate-like member has a respective flange along each minor side of the oblong, the flanges support the skirt at the minor sides to prevent it from hinging, and the skirt along the minor side includes blind apertures extending into the skirt from its distal edge. By that means, the safety at the minor sides can be achieved by energy absorption as described in British patent specification 1,535,728, safety at the major sides, which represent the most dangerous parts of a swing seat, can be achieved in accordance with the present invention, and the strength of the seat can be maintained by the flanges.

Preferably, the resilient polymeric material overlies the whole of that surface of the plate-like member that is uppermost in use.

Preferably, the resilient polymeric material is bonded to the plate-like member.

Preferably, the plate-like member is embedded in the polymeric material.

The polymeric material may comprise natural or synthetic rubber compression molded to the plate-like member, the plate-like member being of metal.

Advantageously, the plate-like member has strengthening projections extending out of the plane of the plate-like member.

The strengthening projections may comprise corrugations in the plate-like member.

The strengthening projections may comprise integrally-formed dependent ribs.

Advantageously, the plate-like member is made of metal. When the strengthening projections comprise integrally-formed ribs, the metal is preferably a lightweight alloy.

Advantageously, the inner side of the dependent skirt is connected to the underside of the plate-like member by a multiplicity of buttress-like webs of the polymeric material. Such buttress-like webs can buckle in an impact and so contribute to the safety of the seat.

BRIEF DESCRIPTION OF THE DRAWINGS

By way of example only, swing seats constructed in accordance with the invention will now be described with reference to the accompanying drawings, in which:

Referring to the accompanying drawings, FIGS. 2 and 3 are sectional views of the swing seat described with reference to FIGS. 1 to 3 of U.S Pat. Nos. 4,066,258 1,535,728, the disclosure of which is incorporated herein by reference U.S Pat. No. 4,066,258 corresponds to British Patent No. 1,535,728. The reader should refer to that specification for details of construction, materials, dimensions and so forth; the present description will be confined essentially to the modifications necessary to make a seat in accordance with the present invention. FIGS. 2 and 3 are respectively sections taken across and along the rectangular seat as marked in FIG. 1 and the drawings of the specification in question.

Figure 1:
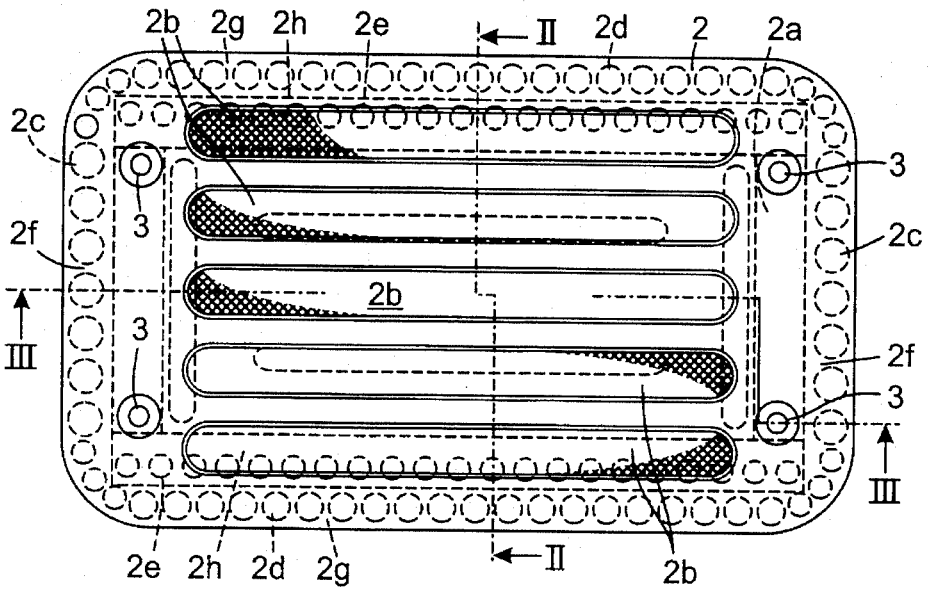
PRIOR ART Fig. 1
FIG. 1 is a view of a prior art swing seat.

The seat comprises a plate-like generally rectangular mild steel member 1 and a cushioning member 2 made out of resilient polymeric material. The steel member 1 is provided with an integral flange 1*a* which depends at right-angles from its peripheral edge. This flange 1*a* increases the rigidity of the member 1. Those parts of the flange 1*a* depending from the longer sides of the member 1 are provided with a reinforcing strip 1*b*.

The cushioning member 2 is arranged to cover the entire surface of the steel member 1 and is compression molded to the steel member 1. That part of the cushioning member 2 surrounding the flange la of the steel member 1 forms a border 30 with a dependent skirt 40 and is provided with three sets of blind apertures 2*c*, 2*d* and 2*e*.

The parts indicated by the reference numerals 1*c*, 1*d*, 2*b*, 2*e*, 2*g*, 2*h*, 3, 11, 12*a*, 12*c*, 12*e*, 14, and 15 are discussed in U.S. Pat. No. 4,066,258, which is incorporated herein by reference.

When the swinging seat hits an object, such as the head of a child, the initial deformation is taken by the outer "skin" and on the thin columns left between the apertures 2*d*. That permits the soft outer "skin" of the cushioning member 2 to deform to the contours of the impacted area of the object. That is followed by a buckling of the larger columns left between the apertures 2*e* which absorbs the main energy of the impact. The extra row of blind apertures 2*e* provided at the front and rear of the seat ensure increased compressibility at those places most likely to hit a child.

The rows of apertures 2*c* at the sides of the seat act in a similar way to cushion impacts in those regions.

It is to be noted that, essentially, the buckling of the columns is responsible for the energy absorption in that construction. Equally, it is to be noted that the buckling of the columns is able to take place only because the dependent skirt 40 is firmly supported at its inner side by the flange 1*a*. In an impact, the cushioning member 2 is, in effect, squeezed between the impacting object and member 1 and unless the dependent skirt 40 is firmly supported at its inner side, that squeezing and consequent buckling cannot take place.

We have now discovered that if one removes the firm support for the inner side of the cushioning member of such a seat, then the seat, most surprisingly, shows a dramatic improvement in results under the impact safety test of British Standard No. 5696. In that safety test, a seat suspended by chains is permitted to fall freely against a test object, representing a child's head, placed centrally at the lowest part of the arc of swing. That dramatic improvement is indeed very surprising when one takes into account that the safety provided by the buckling of the columns supported by the flange la has made the swing seats described in British specification No. 1,535,728 a commercial success for about fifteen years and has resulted in many imitations and copies. In test, an example of a seat according to the invention was found to be deflected upwards off the test object because of the hinge-action and the collision was more glancing and less severe as a result.

Figure 4:
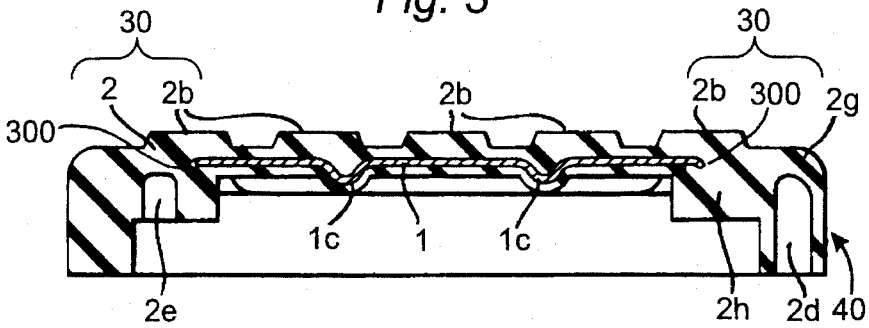
FIGS. 4 and 5 correspond to FIGS. 2 and 3, but include modifications in accordance with the present invention.
Figure 5:
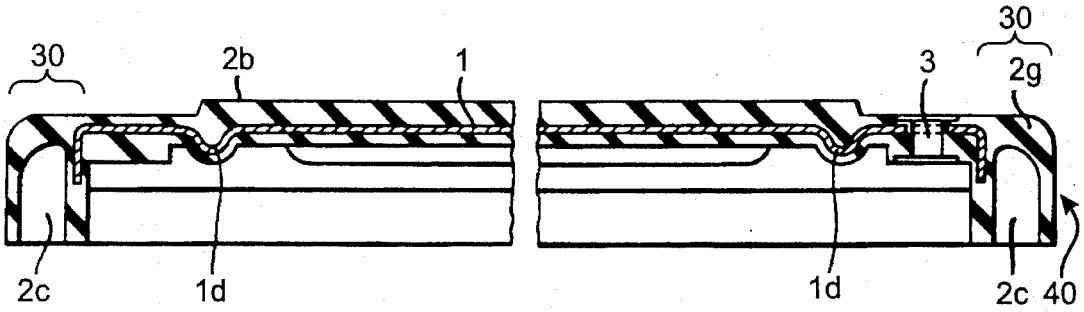

Referring now to FIGS. 4 and 5, it will be seen that on the long sides of the seat in accordance with the invention the flange 1*a* and reinforcing strip have been omitted and the member 1 terminates instead in a small lip 300. Surprisingly, the benefits achieved by that modification greatly outweigh the loss of strength and rigidity in the member 1 and the loss of support for the buckling columns provided by the flange 1*a*. If desired, however, the strength of the seat can be restored by welding a reinforcing strip or strips in the central region of the member 1 and/or by using a stouter gauge material.

The lip 300 is optional and has a depth of about 6 millimeters (measured from the top surface of the member 1 to the bottom of the lip) but avoids the member 1 presenting a knife-like edge.

In order not to weaken the member 1 further, however, the short sides of the seat are left unmodified as seen in FIG. 5 and provide safety in the manner described in British specification No. 1,535,728. If desired, the flange could be omitted on the short sides also and the member 1 made of stouter gauge material and/or reinforced by strips to increase its strength again.

The polymeric material 2 in the region of the lips 300 and extending into the dependent skirt 40 is able to act as a hinge in an impact and, surprisingly, the progressive deformation of the skirt and the forcing of it to hinge inwards against the resilience of the hinge-like portion is much safer in an impact than the very successful buckling column structure of British patent No. 1,535,728.

Figure 6:
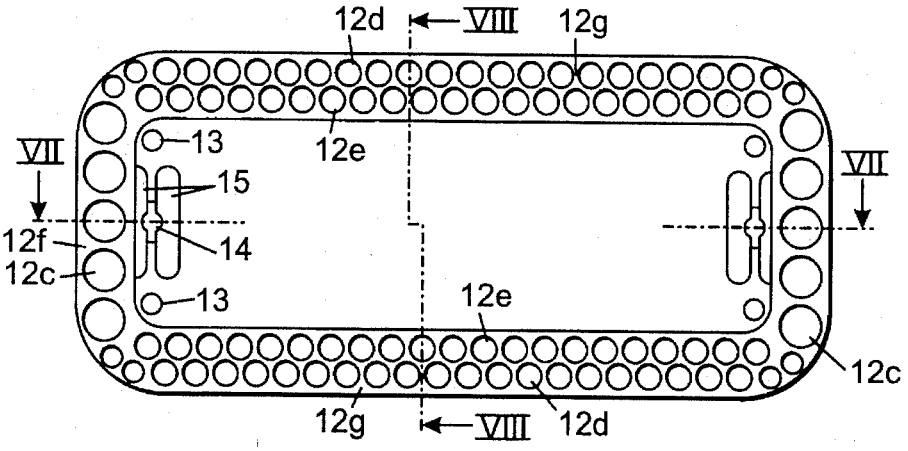
PRIOR ART Fig. 6
FIG. 6 is a view of a prior art swing seat.
Figure 7:
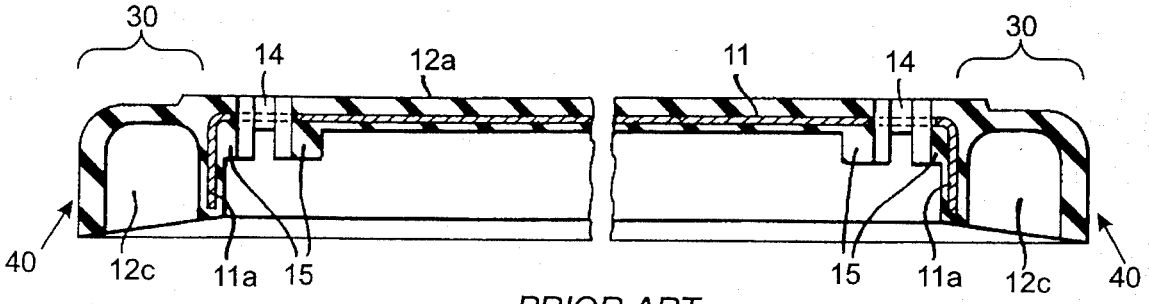
PRIOR ART Fig. 7
FIGS. 7 and 8 are cross-sectional views taken along lines VII and VIII of FIG. 6, respectively.
Figure 8:
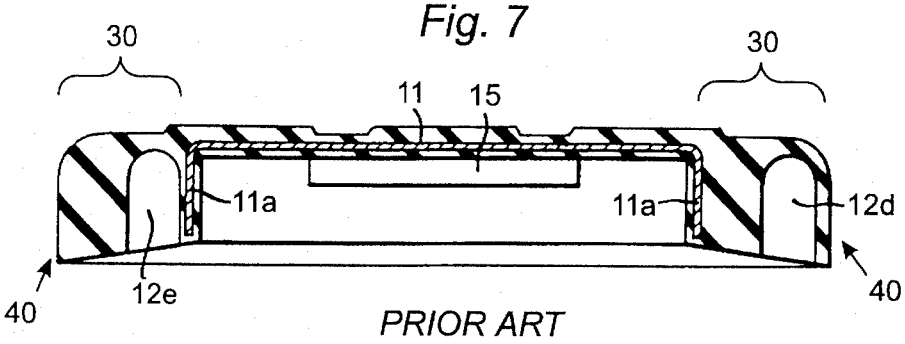
PRIOR ART Fig. 8
Figure 9:
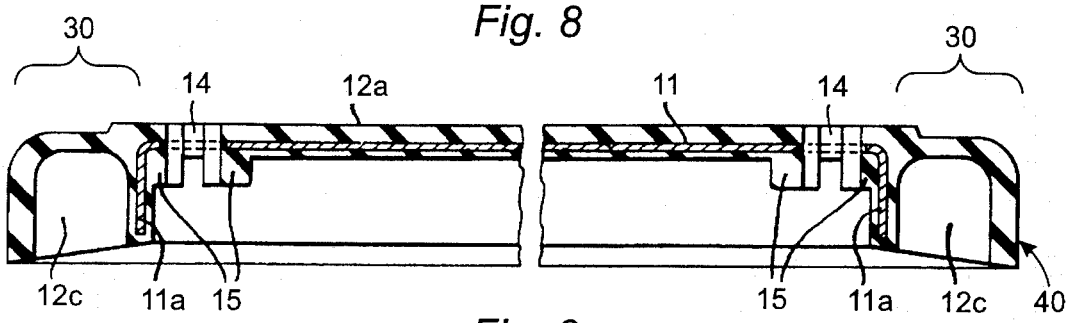
FIGS. 9 and 10 correspond to FIGS. 7 and 8, but include modifications in accordance with the present invention.
Figure 10:
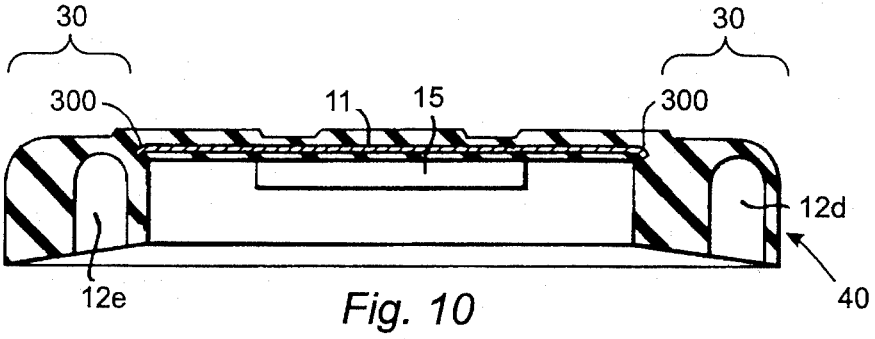

In a similar manner, the swing seat of FIGS. 6, 7 and 8 is modified by the omission of the flange 11*a* on the long sides of the seat to produce the seat in accordance with the invention represented by FIGS. 9 and 10.

Figure 11:
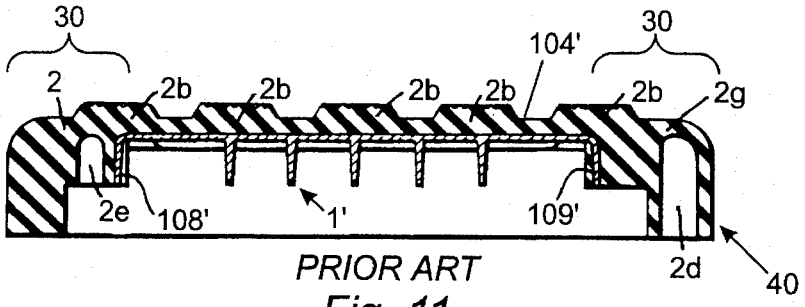
PRIOR ART Fig. 11
FIG. 11 is a view of a prior art swing seat.

The invention can also be applied to the swing seat described with reference to British patent No. 2,037,595, the disclosure of which is also incorporated herein by reference. Referring to FIG. 11, the core member 1 of the earlier figures is here replaced by a core member 1'. The core member 1' consists of an extruded section 100' of aluminium alloy and two aluminium alloy angle members (not shown here but shown in the specification in question) riveted thereto. The extruded section 100' defines a laminar body portion 104' with seven ribs depending therefrom. The outermost of the ribs define peripheral flanges 108', 109' and each rib is tapered, being thinner at its distal ends. For further details of construction, materials, dimensions and so forth, the reader should consult the specification in question directly.

Figure 12:
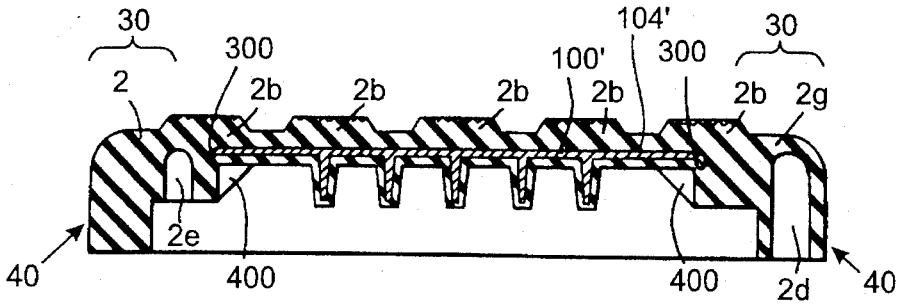
FIG. 12 corresponds to FIG. 11, but includes modifications in accordance with the present invention.

FIG. 12 shows the seat of FIG. 11 modified to accord with the invention. The outermost ribs or flanges 108' and 109' of the extrusion 100' are omitted and the long edges of the extrusion terminated instead in a small lip 300 as in FIGS. 4 and 9. On the long sides, the inner side of the dependent skirt 40 is connected to the underside of the plate-like member 1' by a multiplicity of buttress-like webs 400 of the polymeric material. The polymeric material is also molded about the ribs of the extrusion 100'. The short sides of the seat are preferably left unmodified as in the case of FIGS. 5 and 10.

The seat of FIG. 12 performs in impact in essentially the same manner as the seats of FIGS. 4, 5 and 9, 10, and 8 but with some additional benefits derived from the lightness of the alloy member 1' and the contribution of the buttress-like webs 400 which buckle in impact.

Figure 13:
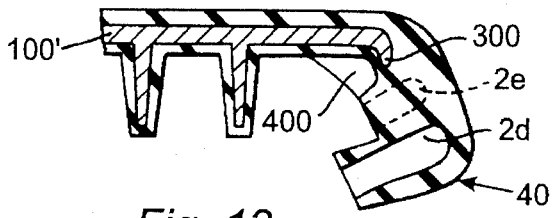
FIG. 13 is an enlarged view of a portion of FIG. 12 in a deflected mode.

FIG. 13 indicates the hinge-like action of the long sides of the seat in an impact and it is to be noted that the dependent skirt 40 is being forced underneath member 1'.

Figure 3:
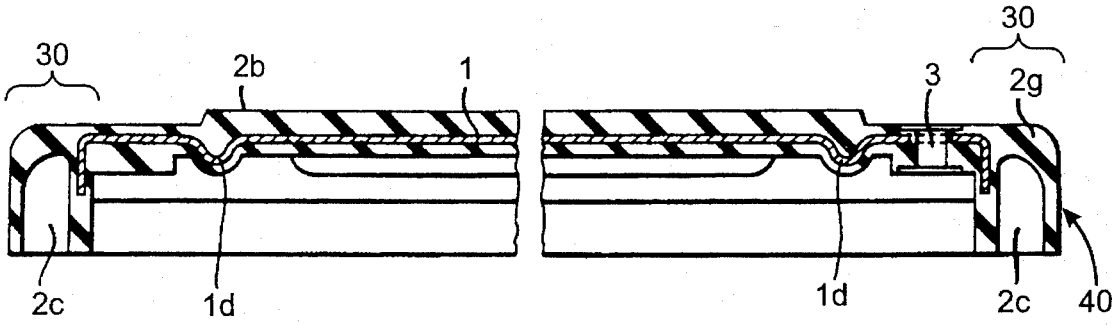
PRIOR ART Fig. 3
Figure 14:
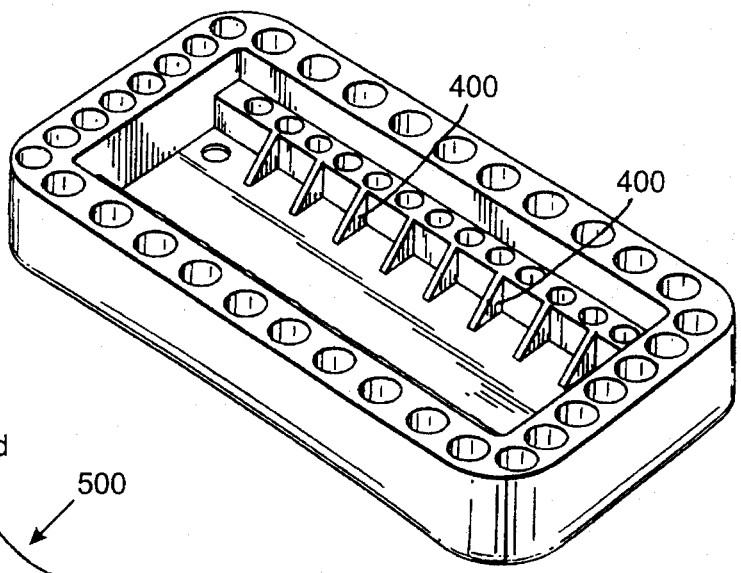
FIG. 14 is a perspective view of the underside of another embodiment of the present invention.

FIG. 14 shows how the buttress-like webs may be applied to a seat generally of the configuration shown in FIGS. 3, 4 and 5.

Figure 15:
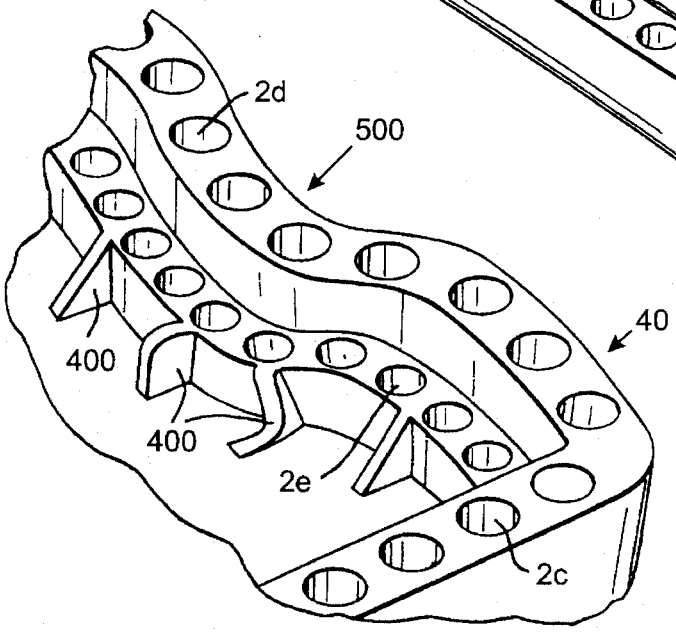
FIG. 15 is an enlarged view of a portion of FIG. 14 in a deflected mode.

FIG. 15 shows the deformation of the dependent skirt 40 and how it is forced to hinge inwards causing the webs 400 to buckle in an impact with an object represented by the arrow 500. The effect of the webs 400 and any column buckling as described in British patent specification No. 1,535,728 is very minor in comparison with the effect of the progressive deformation and forced hinging inwards as a safety mechanism.

Figure 16:
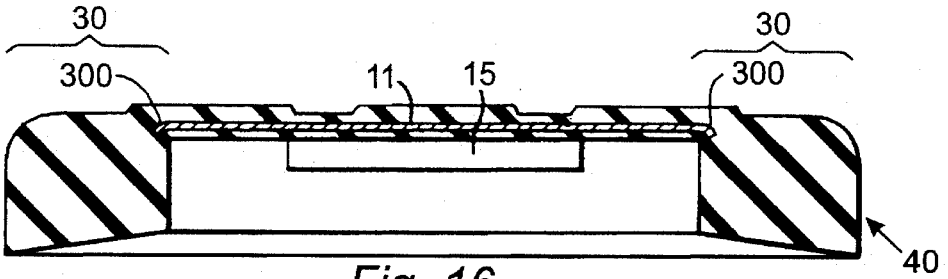
FIG. 16 corresponds to FIG. 10, except that it illustrates a dependent skirt of solid form.
Figure 2:
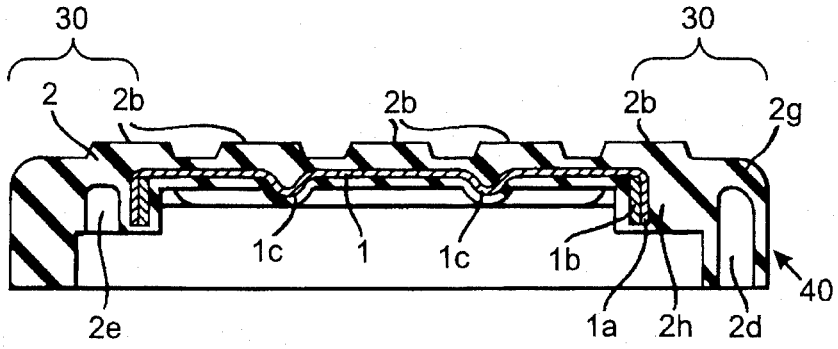
PRIOR ART Fig. 2
FIGS. 2 and 3 are cross-sectional views taken along lines II and III of FIG. 1, respectively.

FIG. 16 shows a modification in which the dependent skirt is of solid form.

The seats just described are provided with apertures by which they can be suspended from a frame by chains or rope in the usual manner of a bench-type swing seat. It is also possible, however, to apply the invention to a cradle-type swing seat by providing a cradle-type superstructure above a seat as described with reference to FIGS. 4 and 5, 9 and 10, 12 or 14.

It is not necessary that the blind apertures be of round section, they may, for example, be of square cross-section.

The invention is applicable to other shapes of seats besides rectangular although oblong shapes are preferred. In particular, the seat may be generally rectangular with the long sides of the rectangle each forming a shallow V so that the overall shape is lozenge-like.

I claim:

1. A seat for a child's swing, the seat comprising:

a plate-like member to bear a weight of a user sitting on the seat, said plate-like member having sufficient mass to be substantially rigid;

resilient polymeric material secured to the plate-like member;

a border of said resilient polymeric material extending beyond an outline of the plate-like member;

a peripheral dependent skirt surrounding the plate-like member, said skirt being formed by said border of said resilient polymeric material extending beyond said outline;

a hinge-like portion of said resilient material within said border connecting said resilient polymeric material secured to said plate-like member to said peripheral dependent skirt;

said plate-like member in a region of the hinge-like portion configured to provide room for the peripheral dependent skirt to hinge beneath the plate-like member; and said skirt and hinge-like portion adapted to cooperate, in an impact between an edge of the seat adjacent the hinge-like portion and an object, with a reaction force created by decelerating said substantially rigid plate-like member and resilient polymeric material secured thereto by said skirt deforming progressively and hinging inwardly against a resilience of the hinge-like portion.

2. A seat as claimed in claim 1, wherein the skirt has a thickness of at least fifteen millimeters, a depth of at least 25 millimeters, and includes a multiplicity of blind apertures extending into the skirt from a distal end of the skirt.

3. A seat as claimed in claim 1, wherein the dependent skirt has a thickness selected from the group consisting of at least ten millimeters, at least fifteen millimeters, and at least twenty millimeters.

4. A seat as claimed in claim 1, wherein the skirt is constituted by a solid wall of the polymeric material.

5. A seat as claimed in claim 1, wherein the thickness of the skirt at its base is substantially equal to the width of the border.

6. A seat as claimed in claim 1, wherein the overall depth of the skirt is selected from the group consisting of at least 25 millimeters, and at least 35 millimeters.

7. A seat as claimed in claim 1, wherein the depth of the dependent skirt is selected from the group consisting of at least five times the depth of the plate-like member at its periphery, at least eight times the depth of the plate-like member at its periphery, and at least ten times the depth of the plate-like member at its periphery.

8. A seat as claimed in claim 1, wherein the plate-like member has a lip at its periphery.

9. A seat as claimed in claim 1, wherein the seat is oblong, the plate-like member has a respective flange along each minor side of the oblong, the flanges support the skirt at the minor sides to prevent it from hinging, and the skirt along the minor sides includes blind apertures extending into the skirt from its distal edge.

10. A seat as claimed in claim 1, wherein the inner side of the dependent skirt is connected to the underside of the plate-like member by a multiplicity of buttress-like webs of the polymeric material.

11. A seat as claimed in claim 1, wherein the hinge-like portion is constituted by a web of the polymeric material and the resilience of the hinge-like portion is provided by the polymeric material.

12. A seat as claimed in claim 11, wherein the hinge-like portion extends into the skirt.

13. A seat as claimed in claim 1, wherein the dependent skirt is thicker at its base than at its distal end.

14. A seat as claimed in claim 13, wherein the skirt, at least in part, is of stepped cross-section comprising a first, thicker, base section and a second, thinner distal section.

15. A seat as claimed in claim 14, wherein the seat is oblong and the skirt has the stepped cross-section along major sides of the oblong.

16. A seat as claimed in claim 1, wherein the skirt has a thickness of at least fifteen or more millimeters and includes a multiplicity of blind apertures extending into the skirt from its distal end.

17. A seat as claimed in claim 16, wherein the skirt, at least in part, is of stepped cross-section comprising a first, thicker, base section and a second, thinner distal section, and a multiplicity of blind apertures extend into the base section from the distal end of said base section.

18. A seat as claimed in claim 17, wherein the thickness of the skirt at its base is at least twenty-five millimeters.

19. A seat for a child's swing, the seat comprising:

a plate-like member to bear a weight of a user sitting on the seat, said plate-like member having sufficient mass to be substantially rigid;

a lip at a periphery of said plate-like member;

resilient polymeric material secured to the plate-like member;

a border of said resilient polymeric material extending beyond an outline of the plate-like member;

a peripheral dependent skirt of a thickness of at least ten millimeters around edges of the plate-like member, said skirt being formed by said border of said resilient polymeric material extending beyond said outline; and a hinge-like portion formed by a web of said resilient material within said border connecting said resilient polymeric material secured to said plate-like member to said peripheral dependent skirt;

the body of said plate-like member in a region of the hinge-like portion and said lip thereof cooperate to define a space for the dependent skirt to hinge beneath the plate-like member; and said skirt and hinge-like portion are adapted to cooperate with said substantially rigid plate-like member and resilient polymeric material secured thereto such that, in an impact between an edge of the seat adjacent the hinge-like portion and an object, said skirt deforms progressively and hinges inwards against a resilience of the hinge-like portion provided by said web of polymeric material.

20. A seat for a child's swing, the seat comprising:

a plate-like member to bear a weight of a user sitting on the seat, said plate-like member having sufficient mass to be substantially rigid;

resilient polymeric material secured to the plate-like member, said plate-like member and resilient polymeric material defining an inertial mass to be decelerated in an impact;

a border of said resilient polymeric material extending around said plate-like member;

a peripheral dependent skirt surrounding the plate-like member, said skirt being formed by said border of said resilient polymeric material;

a hinge-like portion formed by a web of said resilient polymeric material within said border connecting said resilient polymeric material at said plate-like member with said peripheral dependent skirt;

said plate-like member in a region of the hinge-like portion configured to provide room for the peripheral dependent skirt to hinge beneath the plate-like member; and said skirt and hinge-like portion adapted to deform inwardly against a reaction force generated by the inertial mass of said substantially rigid plate-like member and resilient polymeric material secured thereto in an impact between an edge of the seat adjacent the hinge-like portion and an object.

21. A seat as claimed in claim 20, wherein the skirt has a thickness of at least fifteen millimeters and includes a multiplicity of blind apertures extending into the skirt from a distal end of the skirt.

22. A seat as claimed in claim 20, wherein the skirt, at least in part, is of stepped cross-section comprising a first, thicker, base section and a second, thinner distal section, the seat is oblong and the skirt has the stepped cross-section along major sides of the seat.

23. A seat for a child's swing, the seat comprising:

an oblong plate-like member to bear a weight of a user sitting on the seat, said plate-like member having sufficient mass to be substantially rigid and major sides and minor sides;

a respective flange provided on said plate-like member along each minor side of the oblong;

a respective lip provided on said plate-like member along each major side of the oblong;

resilient polymeric material secured to the plate-like member;

a border of said resilient polymeric material extending beyond an outline of the plate-like member;

a peripheral dependent skirt having a thickness of at least ten millimeters around edges of the plate-like member, said skirt being formed by said border of said resilient polymeric material extending beyond said outline;

a hinge-like portion formed along said major sides by a web of said resilient material within said border connecting said resilient polymeric material secured to said plate-like member to said peripheral dependent skirt;

said plate-like member in a region of the hinge-like portion and said lip thereof cooperating to define a space for the dependent skirt to hinge beneath the plate-like member; and said skirt and hinge-like portion adapted to cooperate with said oblong plate-like member and resilient polymeric material secured thereto such that, in an impact between an edge of the seat adjacent the hinge-like portion and an object, said skirt deforms progressively and hinges inwardly against a reaction force and a resilience of the hinge-like portion provided by said web of polymeric material.

24. A seat as claimed in claim 23, wherein the seat is oblong, the plate-like member has a respective flange along each minor side of the oblong, the flanges support the skirt at the minor sides to prevent it from hinging, and the skirt along the minor sides includes blind apertures extending into the skirt from a distal edge of the skirt.

25. A seat as claimed in claim 23, wherein an inner side of the dependent skirt is connected to an underside of the plate-like member by a multiplicity of buttress-like webs of the polymeric material.

26. A seat for a child's swing, the seat comprising:

a substantially rigid plate-like member;

resilient polymeric material covering the plate-like member and extending beyond the plate-like member;

a first portion of said resilient polymeric material extending beyond said plate-like member and forming a peripheral dependent skirt surrounding the plate-like member;

a second portion of said resilient polymeric material forming means for hinging said peripheral dependent skirt to said plate-like member so as to enable the dependent skirt to deform progressively and hinge beneath the plate-like member upon receipt of an impact to an edge of the seat.

27. A seat as claimed in claim 26, wherein the substantially rigid plate-like member is rectangular and includes a main body having parallel major edges and parallel minor edges, the plate-like member further including a perpendicular flange extending from each of the minor edges, wherein the major edges do not include a perpendicular flange and end the major edges in a configuration that is substantially coplanar with the main body of the plate-like member.

28. A seat as claimed in claim 27, wherein the second portion of said resilient polymeric material extends beyond said plate-like member.

* * * * *